US009279285B2

(12) United States Patent
Lucas

(10) Patent No.: US 9,279,285 B2
(45) Date of Patent: Mar. 8, 2016

(54) FOLDING SHUTTER ARRANGEMENT

(76) Inventor: Bernhard Lucas, Lingen (DE)

( * ) Notice: Subject to any disclaimer, the term of this patent is extended or adjusted under 35 U.S.C. 154(b) by 0 days.

(21) Appl. No.: 13/978,642

(22) PCT Filed: Jan. 16, 2012

(86) PCT No.: PCT/EP2012/000157

§ 371 (c)(1),
(2), (4) Date: Jul. 8, 2013

(87) PCT Pub. No.: WO2012/095324

PCT Pub. Date: Jul. 19, 2012

(65) Prior Publication Data

US 2013/0292067 A1 Nov. 7, 2013

(30) Foreign Application Priority Data

Jan. 15, 2011 (DE) ..... 20 2011 001 556 U

(51) Int. Cl.
*E05D 15/26* (2006.01)
*E06B 9/06* (2006.01)
*E05F 15/605* (2015.01)

(52) U.S. Cl.
CPC ..... *E06B 9/0638* (2013.01); *E05F 15/605* (2015.01); *E05D 15/262* (2013.01); *E05Y 2201/62* (2013.01); *E05Y 2900/146* (2013.01)

(58) Field of Classification Search
USPC ..... 160/207, 213, 199, 206, 61, 62
IPC ..... E05D 15/262
See application file for complete search history.

(56) References Cited

U.S. PATENT DOCUMENTS

| | | | | | |
|---|---|---|---|---|---|
| 1,888,456 | A | * | 11/1932 | Ferris | 160/190 |
| 1,912,829 | A | * | 6/1933 | Crume | 160/190 |
| 1,912,830 | A | * | 6/1933 | Crume | 160/190 |
| 3,280,888 | A | * | 10/1966 | Davis | 160/35 |
| 3,344,837 | A | * | 10/1967 | Young | 160/189 |
| 3,504,729 | A | * | 4/1970 | Alton | 160/188 |
| 3,618,656 | A | * | 11/1971 | Young | 160/9 |
| 3,757,845 | A | * | 9/1973 | Pagliaro | 160/189 |
| 4,177,854 | A | * | 12/1979 | DeVore | 160/207 |
| 4,545,418 | A | * | 10/1985 | List et al. | 160/213 |
| 4,637,446 | A | * | 1/1987 | McQueen et al. | 160/207 |
| 5,343,923 | A | * | 9/1994 | Keller | 160/207 |
| 5,560,658 | A | * | 10/1996 | Coolman et al. | 292/28 |
| 6,547,292 | B1 | * | 4/2003 | Keller | 292/242 |

* cited by examiner

*Primary Examiner* — David Purol
(74) *Attorney, Agent, or Firm* — Fay Sharpe LLP

(57) ABSTRACT

A folding shutter arrangement having three or more rigid folding shutter elements having element edges that bend out and element edges that do not bend out in alternation. A first folding shutter element can be fastened to a building so as to be pivotable about a first axis near a element edge that does not bend out. A second folding shutter element is pivotably retained about a second axis near a second element edge that does not bend out. Adjacent folding shutter elements are pivotably connected to each other in pairs at the third element edges by a bend-out joint. A driving element is provided which drives at least one of the element edges in the opening or closing direction, and which forcibly pivots the folding shutter elements connected to at least one of the element edges that do not bend out.

17 Claims, 11 Drawing Sheets

FOLDING SHUTTER ARRANGEMENT

FIELD OF THE INVENTION

The invention relates to a folding shutter arrangement having the features of three or more inherently rigid folding shutter elements having alternately buckling and non-buckling element edges. According thereto, a first folding shutter element is fastened or is fastenable indirectly or directly to a building so as to be pivotable about a first axis, which is positionally fixed or is virtually positionally fixed with respect to the building, in the vicinity of a non-buckling (first) element edge. A second folding shutter element is held pivotably about a second axis, which is shiftable transversely with respect to itself, in the vicinity of a non-buckling second element edge and is shiftable along guides arranged in pairs perpendicularly to the second element edge. The folding shutter elements which are adjacent in pairs are connected pivotably to one another in pairs at their buckling, third element edges, which are opposite and parallel to the first and second element edges, by means of a buckling joint. Pairs of further folding shutter elements on the first two folding shutter elements can adjoin the preceding pair of folding shutter elements. Furthermore, a final folding shutter element which projects freely on the end side can adjoin the pair(s) of folding shutter elements.

TECHNOLOGICAL BACKGROUND

WO 2008/125343 A1 by the same applicant discloses a folding shutter arrangement, in which a locking/unlocking device and optionally a deployment and pulling-up device are provided in the vicinity of the buckling pairs of element edges such that the folding shutter arrangement is moveable from a closing arrangement, which is extended flat per se, into any opening position. In principle, said folding shutter arrangement is also usable for a plurality of pairs of folding shutter elements.

FR 2600892 A1 discloses a folding shutter arrangement for obliquely inclined veranda roofs, in which the folding shutter elements do not adopt an extended position with one another even in the closure position, but rather the adjacent folding shutter elements have already adopted an angular position with one another at the connecting edges thereof, and therefore buckling aids are not required for lack of an extended position. On the contrary, because of the predetermined, slightly buckled basic position of the pairs of folding shutters, a successive, complete buckling of the adjacent pairs of folding shutters occurs during the opening.

DE 20 2004 010 622 U1 discloses a folding shutter arrangement as a door system, i.e. in a vertical orientation, which, in the closed position thereof, permits an extended position of the folding shutter elements aligned with one another. Here, the final (third) folding shutter element, as seen from the fastening edge, can be opened and closed like a door without the adjacent pair of folding shutter elements being moved. All of the opening and closing movements are undertaken manually.

SUMMARY OF THE INVENTION

Proceeding therefrom, the invention is based on the object of realizing a folding shutter arrangement which permits folding shutter arrangements having three or even more sections to move between a closed extended position and an open, buckled position of the folding shutter elements in a simple manner driven by a motor. To solve this problem, a folding shutter arrangement having the features of three or more inherently rigid folding shutter elements having alternately buckling and non-buckling element edges. According thereto, in a folding shutter arrangement of the type in question, provision is made for at least one drive element which is moveable along the guides to drive at least one, preferably the final one, of the non-buckling element edges in the opening and closing directions. By means of at least one coupling element, the folding shutter elements, which are connected to at least one of the non-buckling element edges, are forcibly pivoted in pairs in the opening or closing direction.

By means of the invention, it is possible, inter alia, in the case of horizontally extending folding shutter elements, in particular for openings which are to be closed vertically, but in principle also for inclined or horizontal openings, to drive a lowermost, or final, freely projecting folding shutter element in the opening and closing directions by motor. This makes it possible to obtain favorable light and/or ventilation conditions and/or for relatively large solar panels to be installed in a favorable orientation in the outer side of the folding shutter arrangement. Folding shutter arrangements to be opened and to be closed by motor could hitherto be realized only with an even number of folding shutter elements because the motor-driven element edge furthest away from the coupling point of the folding shutter arrangement on a building had to be guided in the lateral guides.

The invention therefore first of all makes it possible to realize folding shutter arrangements having as many folding shutter elements as desired in an uneven number. However, it is also possible, according to the invention, to realize folding shutter arrangements having an even number of folding shutter elements, such as having two, four, six and more folding shutter elements.

The opening and closing drive, and also the buckling, pulling-up, locking and unlocking can be realized by the invention in a simple manner. The actuating elements for this purpose can be of comparatively simple design and/or accommodated unobtrusively.

Within the context of the invention, the buckling element edges are understood as meaning that region of the folding shutter arrangement at which one element edge or one pair of element edges is remote from the guides during the opening of the folding shutter arrangement transversely with respect to the direction of extension of said guides. By contrast, within the context of the invention, a "non-buckling" element edge is an element edge which, individually or in pairs, always remains in the plane of the guides or parallel thereto and is displaced along the guides or parallel thereto only in the opening direction.

It is now possible in various ways to realize the invention. At least one (first) guide carriage which is moveable along guides arranged at right angles to the second element edges can be provided as the means for the pivotable holding and, in particular pairwise, shifting of the at least one non-buckling, second element edge. Such a guide carriage is basically already known from WO 2008/125343 A1 for folding shutter arrangements having only two folding shutter elements. If, as preferred, the folding shutter arrangement comprises more than two folding shutter elements, such a guide carriage has to remove two element edges in a pivotable manner. This is preferably undertaken by the at least one guide carriage having pivot bearings, which are spaced apart from one another, for the pivoting mounting of the adjacent folding shutter elements. If the pivot bearings separated by such dimensions are located on pivot bearing arms, the desired alignment position of adjacent folding shutter elements can thereby be obtained in a simple manner and the torques occurring at the pivot bearings can be introduced into the guide carriage irrespective of the required distance from the guides. The coupling points on the folding shutter element for the forced pivoting thereof are preferably provided on or in the vicinity of the non-buckling element edge(s) and are therefore, inter alia, arranged substantially unobtrusively. The coupling elements therefore act on the folding shutter elements preferably in positions which are situated on the or in the vicinity of the non-buckling element edges.

The coupling of the moveable drive element to the folding shutter elements, said coupling permitting a forced pivoting of the folding shutter elements into a buckled position or back into an extended position, is particularly preferably undertaken by a (first) coupling element in the form of a sliding element for pivoting one of the folding shutter elements during movement of the moveable drive element. An example of a suitable sliding element is an arrangement similar to a sliding rod which, during the movement of the drive element in the opening direction, leads to a torque being produced on one of the folding shutter elements with the effect of pivoting out same.

The forced pivoting means, in particular the sliding element or in general at least one of the coupling elements, can comprise a separate angle adjustment means, for example a linear drive, for at least one of the folding shutter elements, said angle adjustment means separately increasing or reducing the effective length of the forced pivoting means. This enables the action of the drive element to be superimposed on the folding shutter element to be pivoted, specifically both with the effect of a more rapid pivoting-out movement and with the effect of a retarded or less pronounced pivoting-out movement. Said angle adjustment means can be effective both parallel in time and offset in time to the drive element.

In order to pivot a further folding shutter element during movement of the moveable drive element, at least one further (second) coupling element in the form of a sliding element can be provided. The latter can be similar to a sliding rod, as the (first) coupling element already is, and can be variable in the effective length thereof, optionally separately.

In order to reinforce the effect of the first and/or second coupling element, the moving folding shutter element can comprise a pivot arm which is connected thereto, preferably rigidly, and is actuatable by the coupling element. The coupling element can thereby be arranged comparatively unobtrusively in the direct vicinity of the guide rails and relatively large torques can be introduced into the relevant folding shutter element for pivoting out same.

Unlike in the prior art, for example according to WO 2008/125343 A1, the shifting of the folding shutter elements from an extended position into a buckled position and the pulling-up of the folding shutter elements into the closed extended position can be introduced into the folding shutter elements at a point situated in the vicinity of the non-buckling element edges. The folding shutter elements can be pulled back out of the buckling position thereof, i.e. into the extended position again, by the coupling elements. The buckling and pulling-up are undertaken in a visually very unobtrusive manner, since the previously known buckling and pulling-up elements no longer have to be mounted in the region of the buckling folding element edge.

A particularly favorable pivoting of the folding shutter elements is possible by a (third) coupling element in the form of a pairing of teeth being used. The use of the latter turns out to be particularly simple and effective if intermeshing teeth segments, or optionally gearwheels on the pivot axes of adjacent folding shutter elements, are provided on the non-buckling and/or buckling element edges.

At least some of the folding shutter elements could be equipped with solar cells. The latter can be accommodated, for example, in frames of the folding shutter elements. If at least one pair of folding shutter elements is jointly provided with a self-supporting solar panel, comparatively large solar panel surfaces can thereby be effectively oriented with respect to the sun. At the same time, a favorable shadow effect for the spatial region located therebehind can be obtained. Within the context of the invention, self-supporting solar panels are understood as meaning that there is a corresponding inherent rigidity or reinforcing means, for example a reinforcing grid or frame, are provided.

In order to keep a folding shutter arrangement securely in position in the closed extended position even under wind attack, attack by vandals or in other situations, locking and unlocking means which are known per se can be actuated by at least one drive means which is moveable along the guide, in particular the drive means for opening and closing the folding shutter arrangement, being operatively connected to an idle travel means, by means of which, inter alia, the locking and unlocking of at least one of the folding shutter elements in the, or in the vicinity of, the closed extended position of the folding shutter arrangement and in particular in the vicinity of a folding shutter element edge is permitted. An arrangement of this type is also of independent inventive significance. It can also be used for driving buckling and/or pulling-up means. The idle travel means can optionally also be connected in terms of drive via at least one extension means to the locking and unlocking means and/or to the buckling and/or pulling-up means for at least one of the folding shutter elements such that the locking and unlocking and/or the buckling and/or pulling-up can optionally also be undertaken in a remotely actuated manner simultaneously at different positions along the folding shutter arrangement and preferably in the region of the buckling element edges. An arrangement of this type is also of independent inventive significance.

In principle, it is already possible to use the (first) guide carriage as the moveable drive element; in particular if the distance from the pivot point of the coupling element on the guide carriage can change during the movement by telescopic rails or the like. A simple arrangement of the coupling elements is possible by the fact that at least one (second) guide carriage which is moveable along guides arranged at right angles to the element edges is provided as the moveable drive element. This simplifies the pairwise pivoting of folding shutter elements which are adjacent with respect to a non-buckling pair of element edges.

The components mentioned above and the components claimed and described in the exemplary embodiments and to be used according to the invention are not subject in their size, shaping, choice of material and technical conception to any particular exception conditions, and therefore the selection criteria known in the field of use can be used without restriction.

In summary, there is provided a folding shutter arrangement having three or more inherently rigid folding shutter elements having alternately buckling and non-buckling element edges. The first folding shutter element is fastened or is fastenable indirectly or directly to a building so as to be pivotable about a first axis, which is positionally fixed or is virtually positionally fixed with respect to the building, in the vicinity of a non-buckling (first) element edge. The second folding shutter arrangement is held pivotably about a second axis, which is shiftable transversely with respect to itself, in the vicinity of a non-buckling second element edge and is shiftable along guides arranged in pairs perpendicularly to the second element edge. Adjacent folding shutter elements are connected pivotably to one another in pairs at their buckling, third element edges, which are opposite and parallel to the first and second element edges, by means of a buckling joint. Pairs of further folding shutter elements adjoin the preceding pair of folding shutter elements, and/or a final folding shutter element which projects freely on the end side pivotably adjoins the pair(s) of folding shutter elements in the vicinity of the non-buckling, second, fourth or further element edge. At least one drive element which is moveable along at least one of the guides is provided, said element driving at least one, preferably the final one, of the second, fourth or further non-buckling element edges in the opening or closing direction and, by means of at least one coupling element, forcibly pivoting the folding shutter elements, which are connected to at least one of the non-buckling element edges, in pairs in the opening or closing direction. The coupling elements can act on the folding shutter elements in positions which are situated on or in the vicinity of the non-buckling element edges. At least one (first) guide carriage can be moveable along guides that are arranged perpendicularly to the second element edge is provided as means for the pivotable holding and, in particular pairwise, shifting of the at least non-buckling, second element edge of adjacent folding shutter elements. At least one first guide carriage can have pivot bearings which are separated from each other, for the pivoting mounting of the adjacent folding shutter elements. At least one coupling element can comprise a (first) coupling element in the form of a sliding element for pivoting one of the folding shutter elements during movement of the moveable drive element. At least one coupling element can comprise a (second) coupling element in the form of a sliding element for pivoting a further of the folding shutter elements during movement of the moveable drive element. At least one of the folding shutter elements can comprise a pivot arm which is connected, preferably rigidly, thereto and is actuatable by one of the coupling elements. At least one coupling element can comprise a (third) coupling element in the form of a pairing of teeth for pivoting a further of the folding shutter elements during movement of the moveable drive element. Intermeshing toothed segments can be connected to the pivot axes of the adjacent folding shutter elements. At least some of the folding shutter elements can be equipped with solar cells. At least one pair of folding shutter elements can be jointly provided with an, in particular, self-supporting solar panel. At least one of the forced pivoting means of at least one of the pairings of folding shutter elements can comprise a separate angle adjustment means for at least one of the folding shutter elements. Also, there can be provided a folding shutter arrangement having two or more inherently rigid folding shutter elements having alternately buckling and non-buckling element edges. A first folding shutter element is fastened or is fastenable indirectly or directly to a building so as to be pivotable about a first axis, which is positionally fixed or is virtually positionally fixed with respect to the building, in the vicinity of a non-buckling (first) element edge. A second folding shutter arrangement is held pivotably about a second axis which is shiftable transversely with respect to itself, in the vicinity of a non-buckling second element edge and is shiftable along guides arranged in pairs perpendicularly to the second element edge. Adjacent folding shutter elements are connected pivotably to one another in pairs at their buckling, third element edges, which are opposite and parallel to the first and second element edges, by means of a buckling joint. At least one drive element which is moveable along the guides is provided with or is operatively connected to an idle travel means which permits locking and unlocking of at least one of the folding shutter elements in the or in the vicinity of the closed extended position of the folding shutter arrangement. An idle travel means can be remotely connected in terms of drive via at least one extension means to locking and unlocking means for at least one of the folding shutter elements. At least one (second) guide carriage along guides arranged at right angles to the second element edge is provided as the moveable drive element.

Further details, features and advantages of the subject matter of the invention emerge from the dependent claims, and also from the description below and the associated drawing, in which an exemplary embodiment of a folding shutter arrangement is illustrated by way of example. Individual features of the claims or of the embodiments may also be combined with other features of other claims and embodiments.

DETAILED DESCRIPTION OF EXEMPLARY EMBODIMENTS

Figures 1A, 1B, 1C:
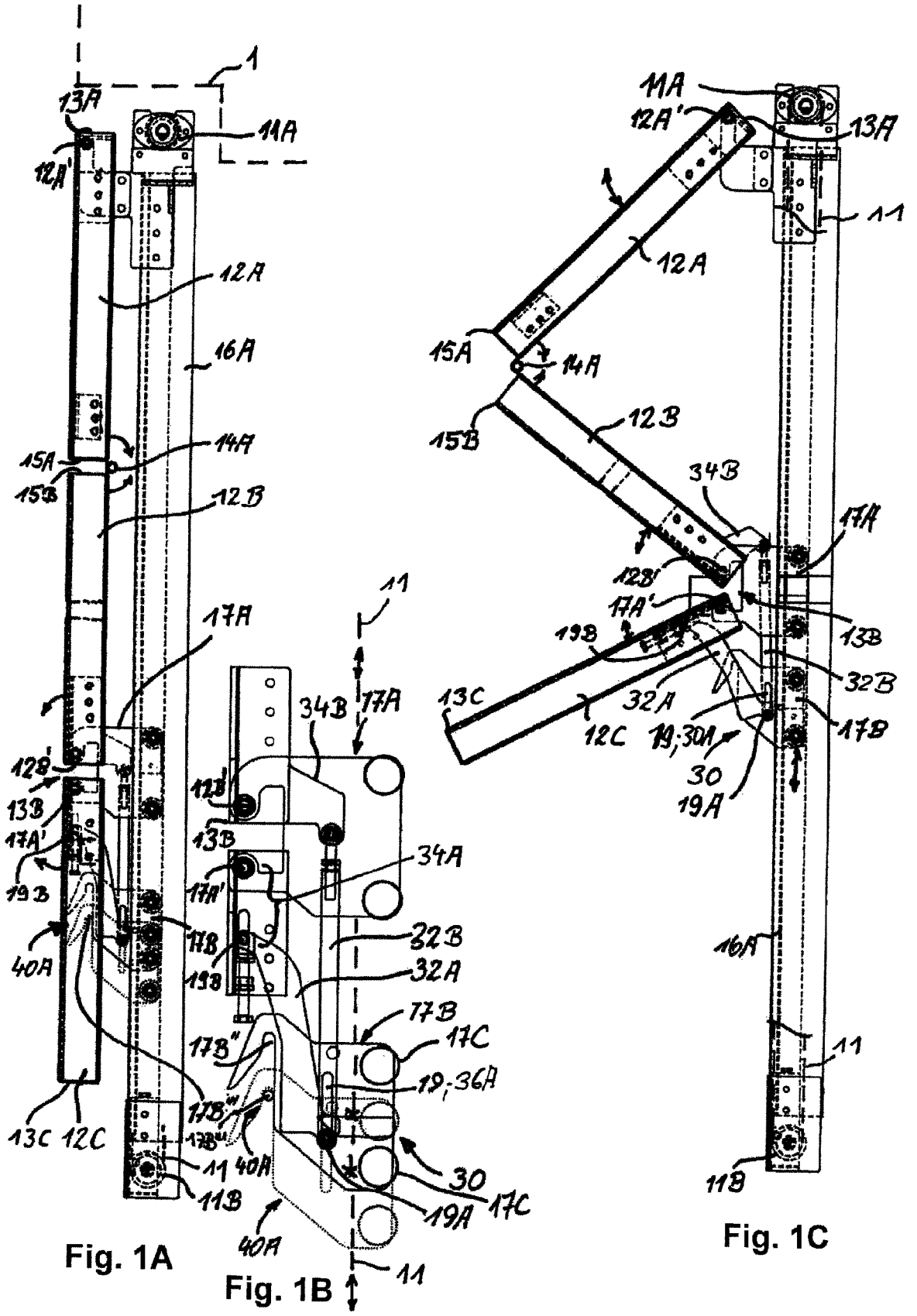
FIG. 1A shows a side view of a folding shutter arrangement having three folding shutter elements in a closed position.
FIG. 1B shows the same folding shutter arrangement in detail.
FIG. 1C shows the same folding shutter arrangement in the approximately half-buckled state of the folding shutter elements.

The three-section embodiment according to FIGS. 1A to 1D shows one of two guides 16A, 16B, which stand vertically and are spaced apart from each other in parallel and in which a first guide carriage 17A and a second guide carriage 17B are vertically moveable. The uppermost of three folding shutter elements 12A, 12B and 12C is indirectly fastened to a building 1 (merely indicated) so as to be pivotable about a positionally fixed axis 12A' in the vicinity of the first (uppermost) element edge 13A. A second folding shutter element 12B is held with respect to the first guide carriage 17A so as to be pivotable about a second axis 12B', which is shiftable transversely with respect to itself, in the vicinity of a non-buckling, second element edge 13B. The second, non-buckling element edge 13B is shiftable vertically by means of the guide carriage 17A along the guides 16A, 16B, which are arranged in pairs at right angles to the second element edge 13B. The adjacent folding elements 12A and 12B form a (first) pair of folding shutter elements. The folding shutter elements are connected to one another pivotably in pairs by means of a buckling joint 14A at their buckling, third element edges 15A, 15B, which are opposite in parallel to the first and second element edges 13A, 13B. A further (third) folding element 12C adjoins the pair of folding elements 12A, 12B on the end side as the final folding element and has a freely projecting element edge 13C. The third folding shutter element 12C is mounted in a freely projecting manner in the vicinity of its upper element edge so as to be able to pivot about a pivot bearing 17A', which is located on the guide carriage 17A.

The actuation of the folding shutter arrangement now proceeds in the following manner: a drive element, such as a tension strap 11, and in particular a toothed belt running around upper and lower deflecting pulleys 11A, 11B, which tension strap/toothed belt is drivable in both directions in the region of an upper and/or lower deflecting pulley 11A, 11B, in particular by means of an electric motor, acts on the second (lower) guide carriage 17B, which is moveable vertically along the guides 16A and 16B via guide rollers 17C. The drive means and the elongate guide carriage 17B are referred to overall as a drive element 30. A first coupling element 32A and a second coupling element 32B are each fastened pivotably to the second guide carriage 17B. A sliding rod is used as the first coupling element 32A, said sliding rod being fastened by its lower pivotable coupling point (pivot point 19A) to the second guide carriage 17B and by its upper pivotable coupling point (pivot point 19B) to the third folding shutter element 12C at a distance and lateral offset below the pivot bearing 17A', thus producing a pivot arm 34, and the first coupling element 32A is thereby able to exert a torque on the third folding shutter element 12C. The second coupling element 32B is likewise designed as a sliding rod and is connected pivotably to the second guide carriage 17B, for example at the same connecting point as the first coupling element. At its second, upper end, the second coupling element 32B acts on a pivot arm 34B. The latter is connected rigidly, i.e. non-pivotably, to the second folding shutter element 12B, in the lower region thereof, and therefore the pivot arm 34B exerts a torque on the second folding shutter element 12B. The drive means therefore acts on the first guide carriage 17A only indirectly, namely by means of the second coupling element 32B and the pivot arm 34B. The first guide carriage 17A is therefore raised and lowered indirectly via the movement of the second guide carriage 17B.

If the second guide carriage 17B is now moved upward (FIG. 1C) out of the closed and locked extended position illustrated in FIG. 1A, during the initial movement only a lower locking and unlocking means 40A is disengaged (FIG. 1B). Said locking and unlocking means 40A comprises a short extension arm with a locking cutout 17B" and a locking stop 17B'", which extension arm protrudes laterally in the lower end region of the third folding shutter element 12C. The extension arm has an elongated hole 19, in which the lower pivot points 19A of the first and second coupling elements 32A and 32B can be displaced by a sufficient length. During the initial opening movement of the second guide carriage 17B, said pivot points 19A are displaced downward with respect to the extension arm, while the locking cutout 17B" moves upward and finally releases the movement stop 17B'", as illustrated in FIG. 1A by dashed lines, and by solid lines in the detailed excerpt according to FIG. 1B. The pivot point 19A is then located at the lower end of the elongated hole 19. A further movement of the second guide carriage 17B upward consequently leads to the two coupling elements 32A and 32B being raised. This in turn leads to the first coupling element 32A slightly pivoting out the lower folding shutter element 12C and to the second coupling element 32B slightly pivoting the pivot arm 34 about the pivot part 17A', and hence the second folding shutter element 12B, i.e. transferring the latter in an extended position into a buckling position, as is apparent in more detail in FIG. 2A. As soon as the second folding shutter element 12B is buckled from the extended position thereof into a slightly buckled position, the first guide carriage 17A can shift upward along the guides 16A, 16B under the lifting action of the first and second coupling elements 32A and 32B. In the process, the buckling movement of the folding shutter elements 12C and 12B continues. At the same time, however, as a consequence of the buckling movement of the second folding shutter element 12B and indirectly by means of the second coupling element 32B, the first folding shutter element 12A is also pivoted outward about the first axis 12A'. The first guide carriage 17A and the three folding shutter elements 12A-C then follow the lifting movement of the second guide carriage 17B, as is apparent from FIGS. 1C and 1D. The second and third folding shutter elements 12B and 12C are therefore forcibly pivoted in pairs by the drive element 30 and the first folding shutter element 12A is thereby also inevitably pivoted at the same time.

During the closing of the folding shutter arrangement, the second guide carriage 17B is lowered and the first guide carriage 17A follows this movement, because of its own gravitational force and assisted by the gravitational force of the three folding shutter elements 12A to 12C.

Figure 2:
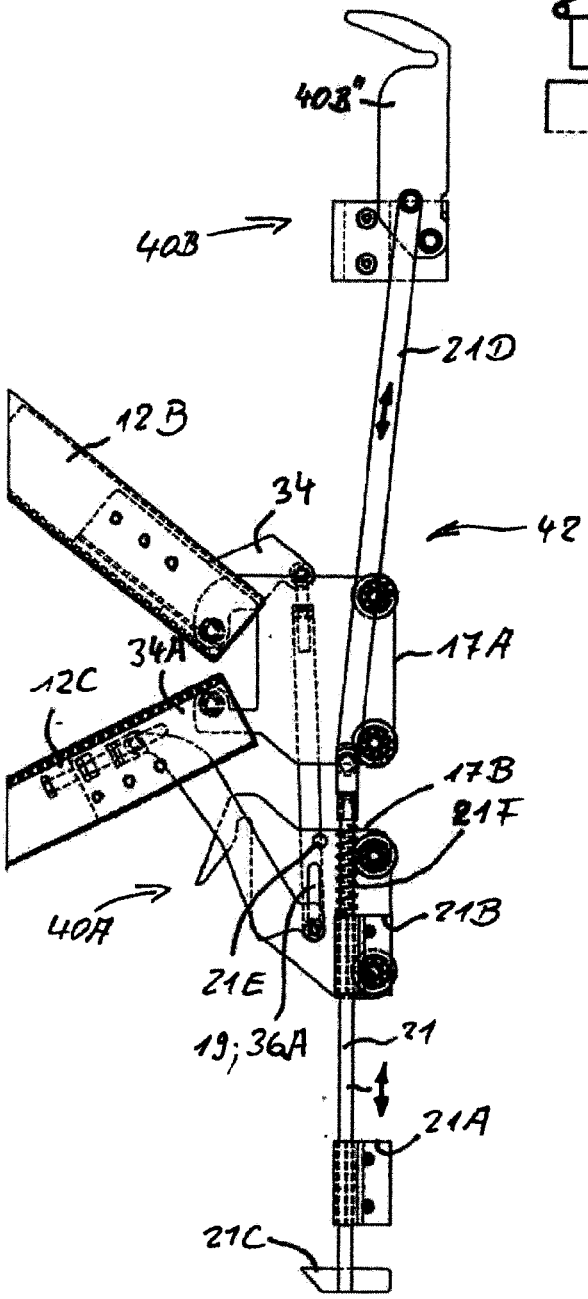
FIG. 2 shows the folding shutter arrangement according to FIG. 10 with an additional upper locking and unlocking element (as an excerpt)
Figure 1D:
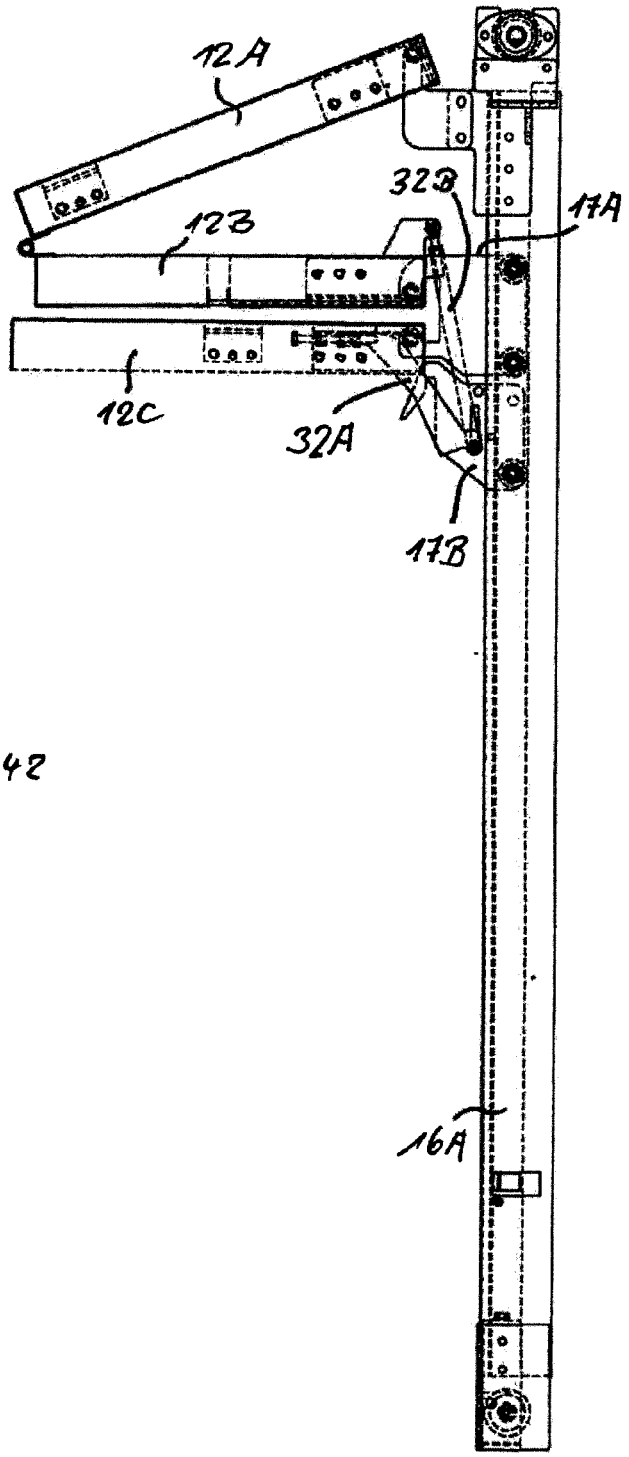
FIG. 1D shows the same folding shutter arrangement in the completely buckled state of the folding shutter elements.
Figure 3A:
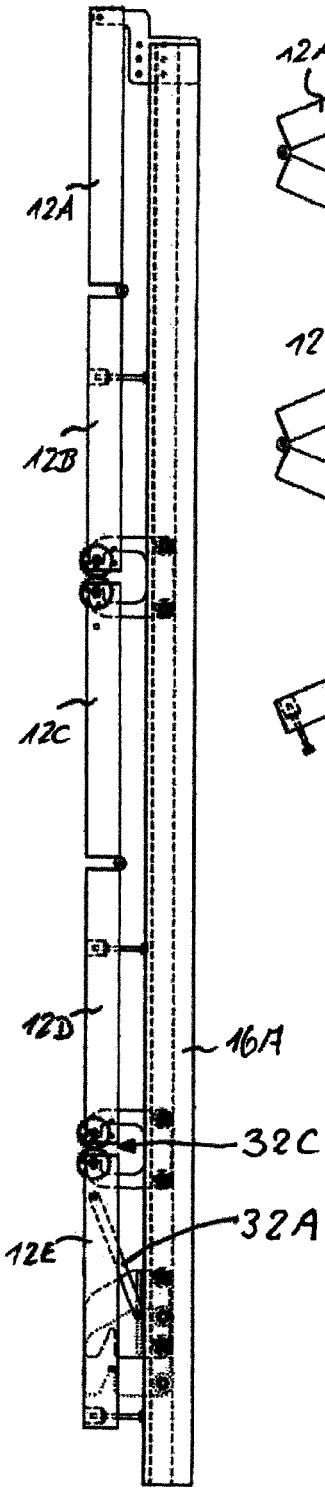
FIGS. 3A-E show a side view of a second embodiment of a folding shutter arrangement with five folding shutter elements (partially as an excerpt) in the closed position (FIG. 3A), in a partially open position (FIG. 3B) and in a complete opening position (FIG. 3C) and in detail (FIGS. 3D and 3E)
Figure 3B:
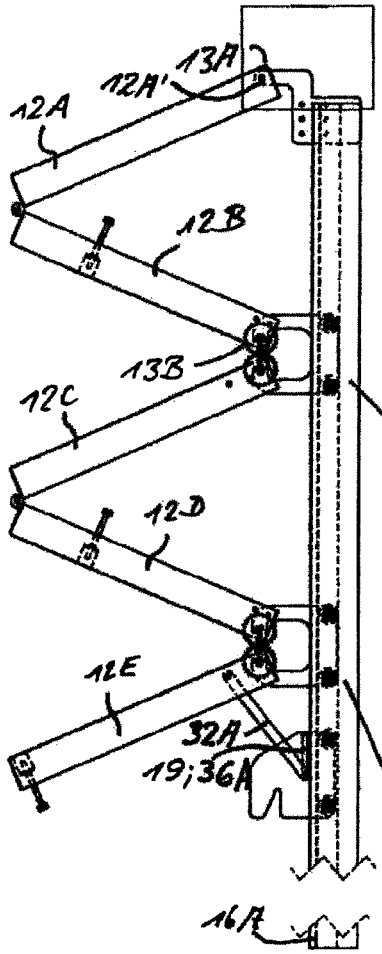
Figure 3C:
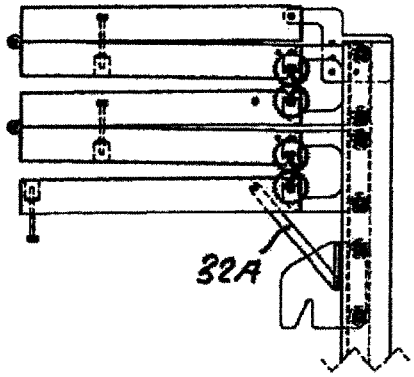
Figure 3E:
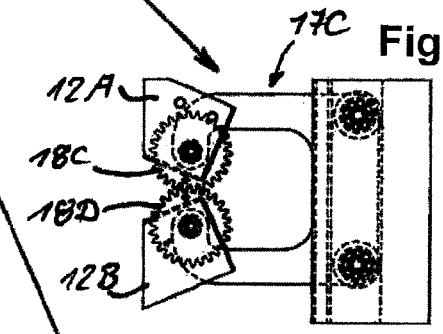
Figure 3D:
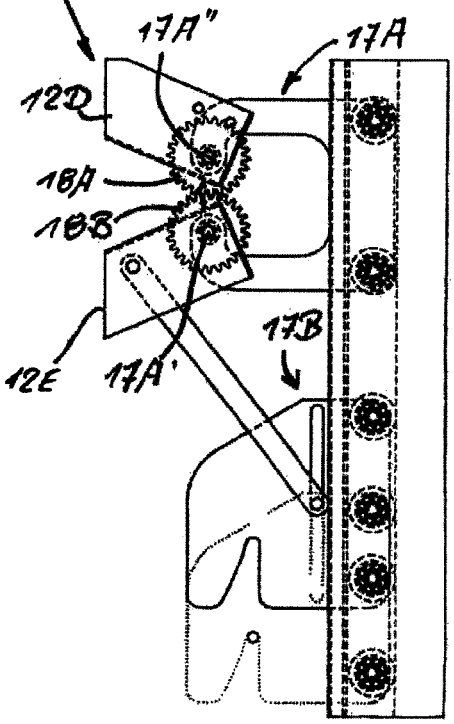
Figures 4A, 4B, 4C, 4D, 4E:
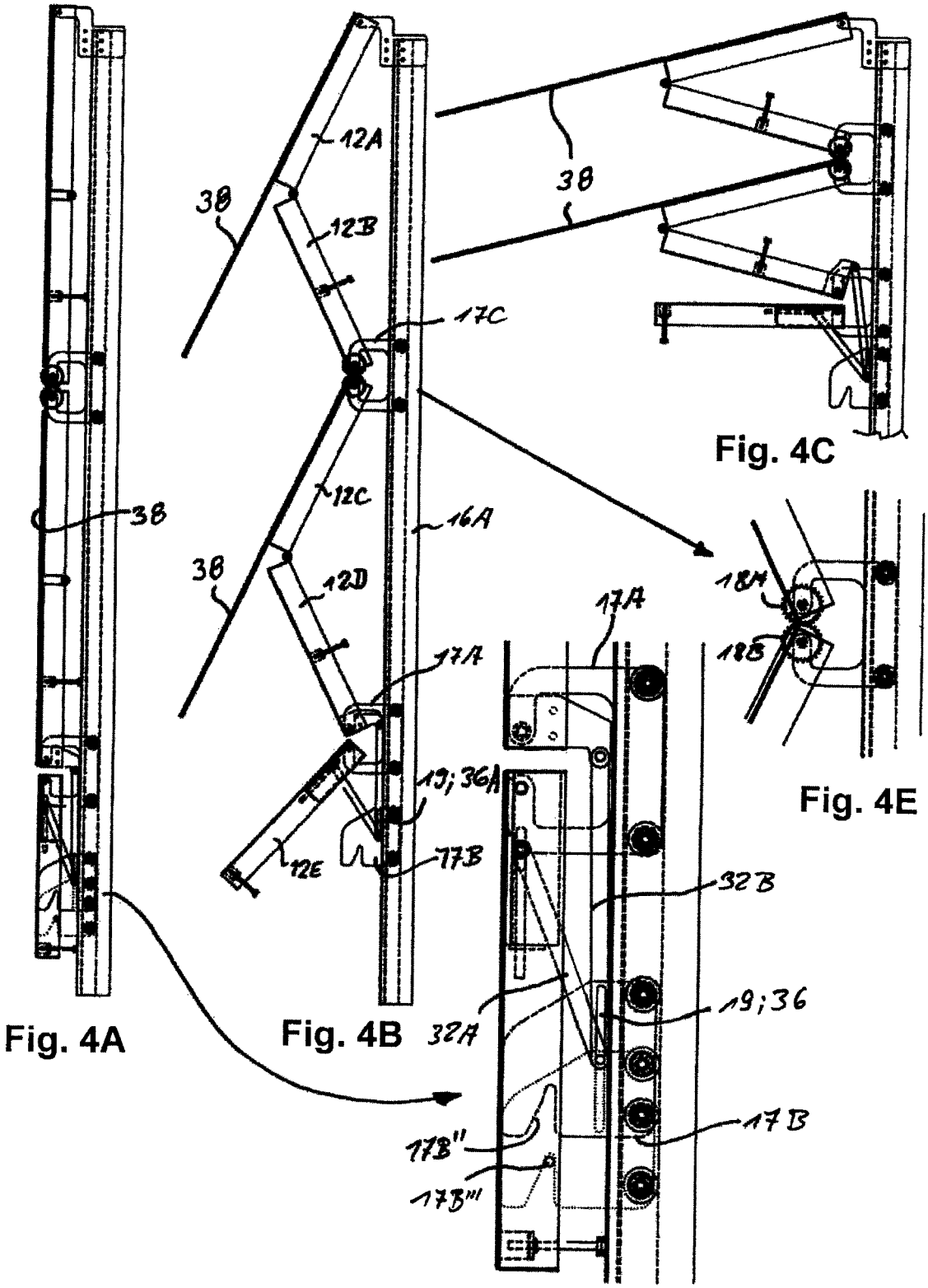
FIGS. 4A-E show a side view of a third embodiment of a folding shutter arrangement having solar panels, with five folding shutter elements (partially as an excerpt) in the closed position (FIG. 4A), in a partially open position (FIG. 4B) and in a virtually complete opening position (FIG. 4C) and also in detail (FIGS. 4D and 4E)

It is apparent from the exemplary embodiment according to FIG. 2 how an, in particular second, locking and unlocking means, the upper one in the exemplary embodiment, can likewise be actuated by the drive element 30: two sliding rod guides 21A, 21B fastened to the relevant guide 16A or 16B guide a sliding rod 21 in a sliding manner and approximately parallel to the guides by means of an, in particular lower, stop 21C and an, in particular upper, sliding rod extension 21D, which is flexible per se or is connected in a slightly pivotable manner to the sliding rod 21. At its upper end in the example, the sliding rod extension 21D is connected pivotably in the driving direction to a locking and unlocking lever 40B", thus resulting overall in an upper locking and unlocking means 40B in the example, which is remotely actuatable by an extension means, denoted overall by 42, and can engage in a locking manner in a locking stop on one of the folding shutter elements. A compression spring 21F loads the upper locking and unlocking means 40B in the direction of an unlocking position, as illustrated in FIG. 2. Locking is served by the drive element 30, at which a stop 21E is provided, the stop coming into contact at the end of the closing movement with the stop 21C and, in the locking phase of the lower locking and unlocking means 40A, simultaneously displacing the extension means 42 downward such that the upper locking and unlocking means 40B also passes into the locking position thereof, as is realized in a similar manner which has yet to be described in the exemplary embodiments according to FIG. 7, 8 or 9.

The second and third exemplary embodiments according to FIGS. 3A to 3C and 4A to 4C differ from the first exemplary embodiment in that, firstly, five folding elements 12A to 12E are provided instead of three folding elements. In the third exemplary embodiment according to FIGS. 4A and 4E, the two pairs of folding elements 12A, 12B and 12C, 12D are covered in the closed state by a solar panel 38 covering the two folding shutter elements, but said solar panel is fastened in each case only to the upper of the folding elements (12A and 12C) of a pairing of folding shutter elements and therefore the lower half of said solar panel projects significantly when the folding shutter arrangement is opened, as is apparent from FIG. 4C.

The difference of the second exemplary embodiment (FIGS. 3A to 3C) from the first exemplary embodiment consists in that, in addition to the first coupling element 32A, a pair of gearwheels 18A, 18B is provided as the (third) coupling element 32C. Said toothed segments are connected to the folding shutter element 12E for conjoint rotation at the upper axis of rotation thereof and are connected to the folding shutter element 12D for conjoint rotation at the lower axis of rotation thereof in the vicinity of the lower element edge. The center points of the gearwheels 18A and 18B are aligned with the pivot bearings 17A' and 17A" of the first guide carriage 17A and are in meshing engagement with each other. The same toothed segment arrangement and a further guide carriage 17C are located on the non-buckling, second element edge 13B at the transition between the second folding shutter element 12B and the third folding shutter element 12C. The function of the first coupling element 32A is the same as in the first exemplary embodiment, i.e. raising of the second guide carriage 17B leads to a slight buckling at the lower, free end of the lower folding shutter element 12E. By means of this buckling movement, the gearwheel 18B is rotated, in particular by the same angular amount, and entrains the gearwheel 18A and the fourth folding shutter element 12D by the same angular amount, with the effect of buckling same. As a result, in turn, the third folding shutter element 12C is inevitably also buckled and the latter, in turn, pivots the second folding shutter element 12B by means of a pairing of gearwheels 18C, 18D on the non-buckling element edge 13B. This, in turn, leads to a forced pivoting of the uppermost folding shutter element 12A about the positionally fixed axis 12A' thereof. Overall, therefore, the entire folding shutter arrangement with all five folding shutter elements is uniformly buckled, specifically as a consequence of the lifting movement of the second guide carriage 17B. The locking and unlocking with the aid of the elongated hole 19, which serves as the idle travel means 36, is the same as in the first exemplary embodiment. By contrast, in the third exemplary embodiment according to FIGS. 4A-E, the pivoting coupling between the fourth and fifth folding shutter elements 12D and 12E takes place as in the first exemplary embodiment according to FIGS. 1A-D between the second and third folding shutter elements 12B and 12C. The pivoting coupling according to FIGS. 4A-E between the second and third folding shutter elements 12B and 12C takes place, in turn, as according to FIGS. 3A-D.

Figures 5A, 5B, 5C:
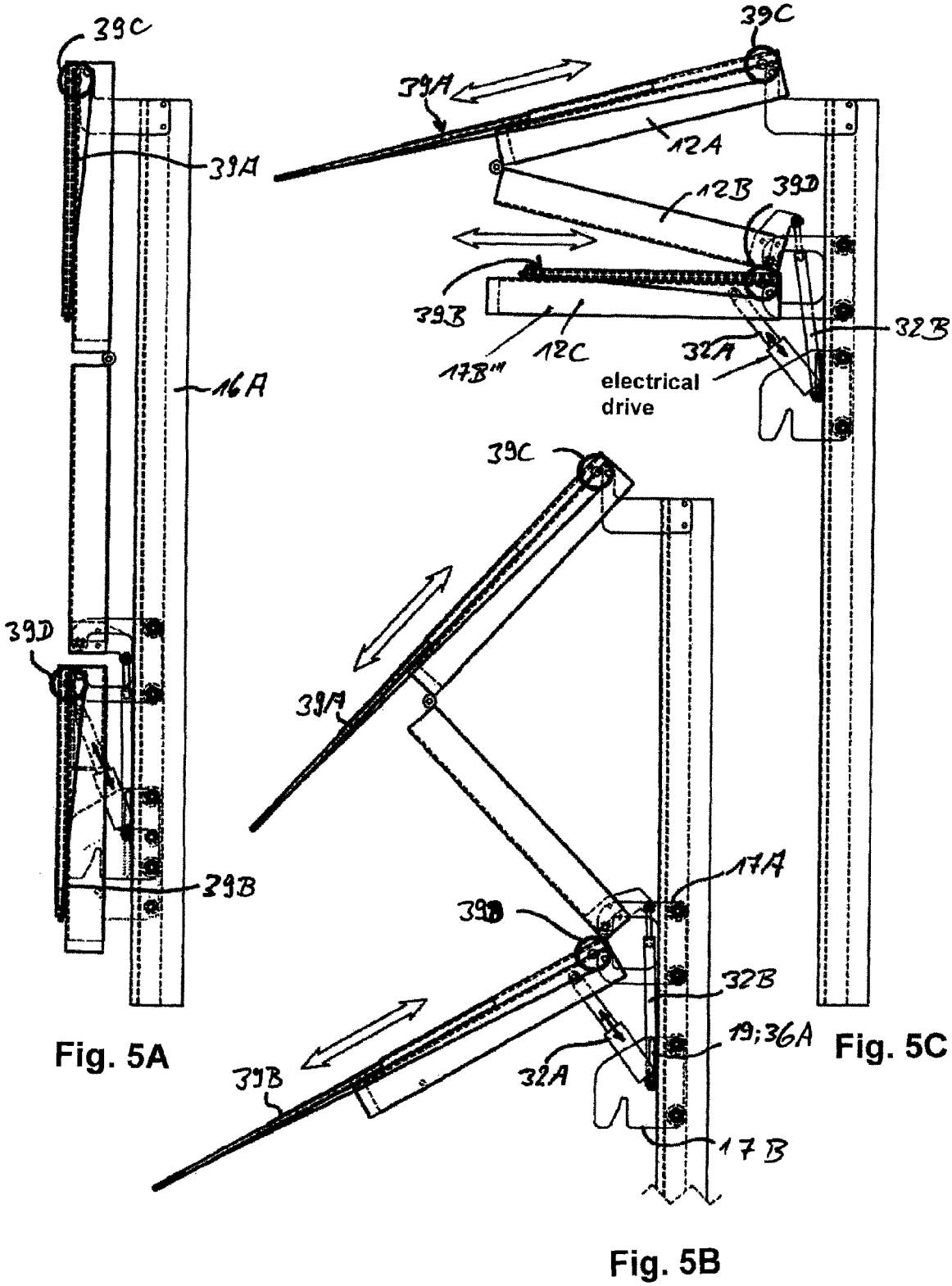
FIGS. 5A-C show a fourth embodiment of a folding shutter arrangement, with three folding shutter elements and telescopic surface elements in a closed position (FIG. 5A), in a partial opening position (FIG. 5B) and in a virtually complete opening position (FIG. 5C)

From the fourth exemplary embodiment according to FIGS. 5A to 5C, two telescopic surface elements 39A, 39B, which can be equipped, for example, with solar panels, are apparent. Said surface elements are preferably the same width as the folding shutter elements and, in the pushed-in state, have a length which is approximately identical to, to somewhat shorter than, the folding shutter elements between the joint regions thereof. In the pushed-in state, as in FIG. 5C at the lower surface element 39B, the building region located therebelow is therefore not shaded. The useful surface of the multi-part, telescopic surface elements 39A, 39B or the surface to be shaded can be changed via telescopic guide rails, in particular arranged laterally. Different drive systems can be used for the extension and retraction thereof. When toothed belts are used, it is possible, as illustrated, for the telescopic sections to be moved in both directions by a drive 39C, 39D in both directions. Alternatively, a belt drive or cable drive with a winding-up mechanism can be operated. The weight of the telescopic arrangement can be used to extend the latter. Multi-part panels are particularly favorable for folding shutter elements located further below, but may advantageously also be used in folding shutter arrangements having two folding shutter elements, such as, for example, according to FIGS. 7A-C, for the upper of the two folding shutter elements. In this fourth exemplary embodiment according to FIGS. 5A to 5C, the difference with regard to the first exemplary embodiment consists in that the first coupling element 32A is independently changeable in length and can be designed, for example, as an electric spindle drive. As is apparent from the full opening position according to FIG. 5C, such an independent adjustment drive may be used to actuate the coupled forced pivoting device for the second and third folding shutter elements 12B and 12C in such a manner that the pivoting angles of said two folding shutter elements differ in size.

Figure 6A:
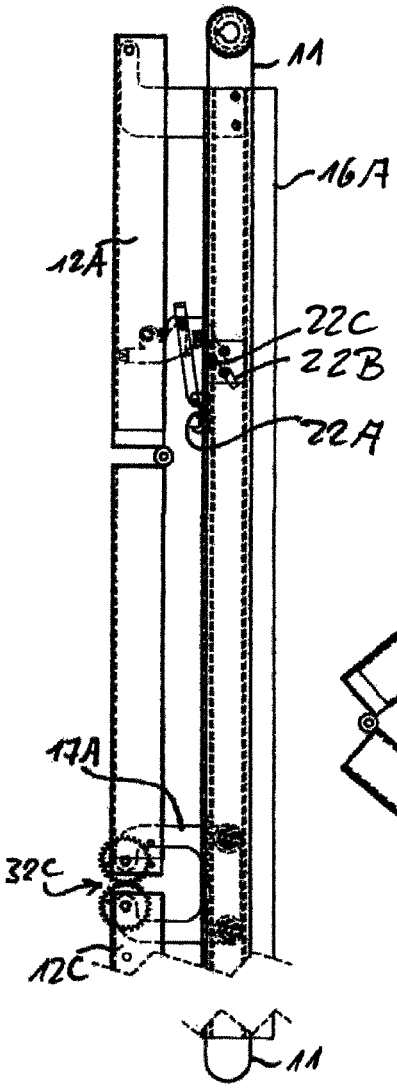
FIGS. 6A-C show a side view of a fifth embodiment of a folding shutter arrangement in a closed position (FIG. 6A), in a partially open position (FIG. 6B) and in a complete opening position (FIG. 6C)
Figure 6B:
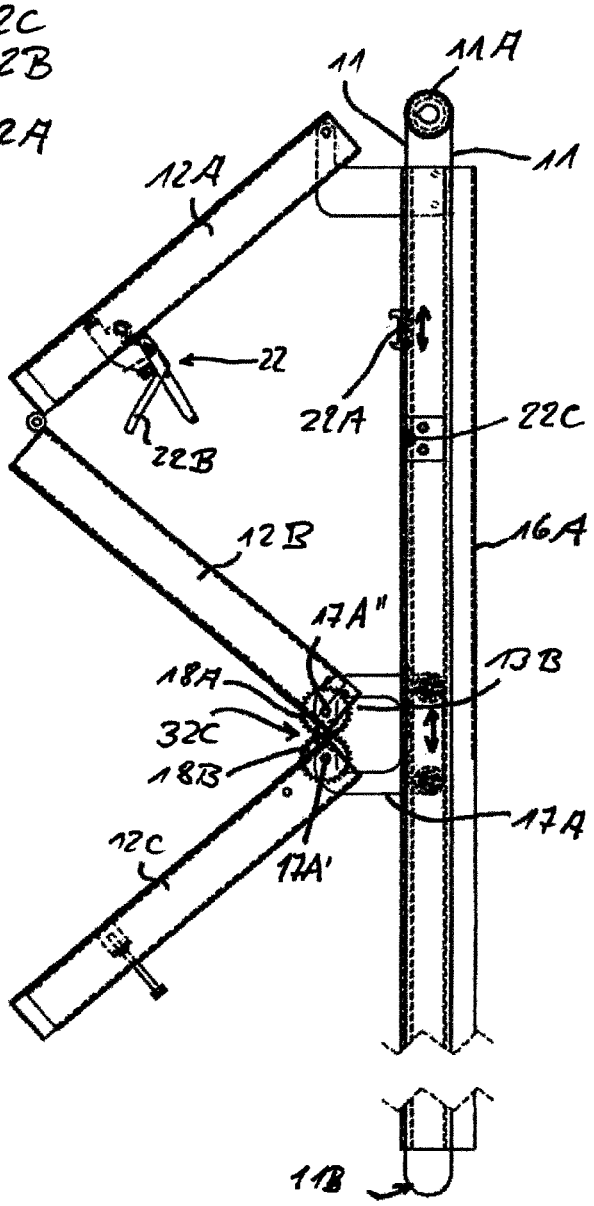
Figure 6C:
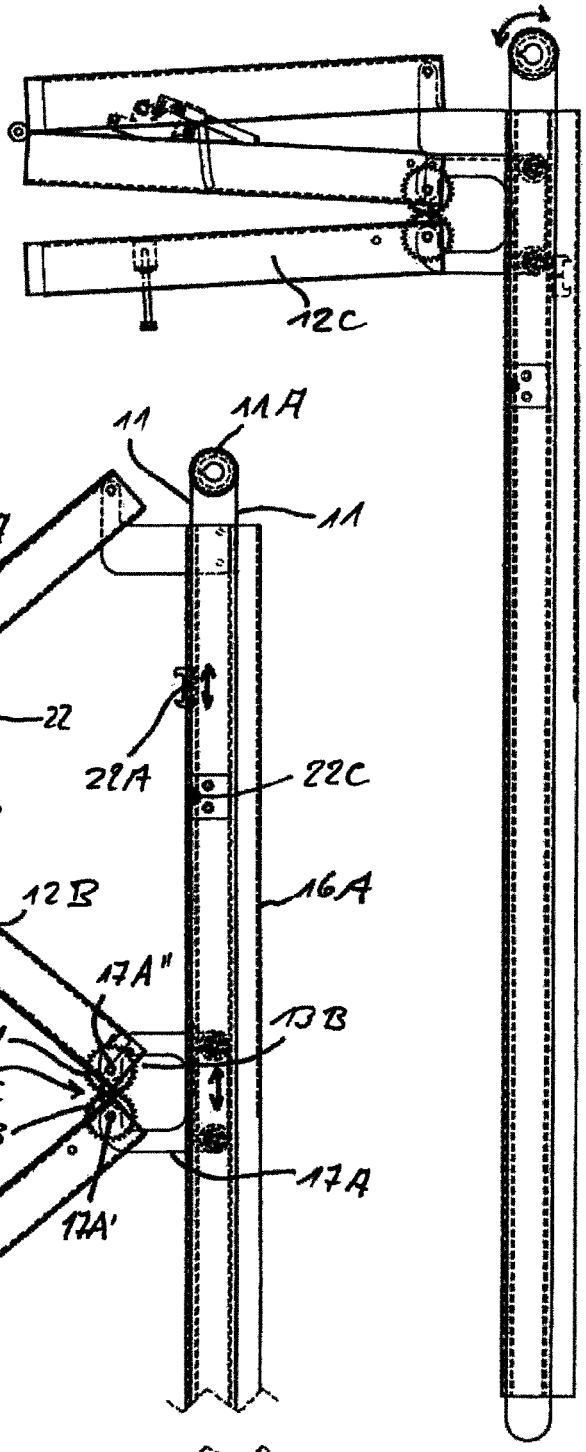

In the exemplary embodiment according to FIGS. 6A to 6C, the buckling in a three-part folding shutter arrangement takes place in a manner known, for example, from WO 2008/125343A1, by means of a pulling-up and locking device 22 which serves at the same time as a buckling means and is actuated via a driver 22A which acts on the pulling-up and locking device 22 in the vicinity of the closing position in the pulling-up and locking direction. During the opening, the driver 22A brings about a force-actuated buckling of the upper folding shutter element 12A and of the folding shutter element 12B which is coupled thereto and is located therebelow. Owing to the coupling element 32C in the form of intermeshing toothed segments in the region of the non-buckling, second element edge 13B, the lower folding shutter element 12C is also buckled and, in the subsequent movement, pivoted out, as is in principle already apparent in conjunction with the exemplary embodiment according to FIGS. 3A to 3E. In principle (differently than illustrated), the pulling-up, locking and buckling means 22 can also be provided on the central folding shutter element (12B) or on the lower folding shutter element 12C, instead of on the upper folding shutter element 12A, and the position of said means between the upper and lower pivot joint of the associated folding shutter element is, in principle, freely selectable. The starting position of the driver 22A, which is fixedly connected to a tension strap 11 and, like the guide carriage 17A, is drivable upward and downward by said tension strap, is selected accordingly. Only one guide carriage 17A is required, said guide carriage being fastened to a driven, revolving tension strap 11, such as a toothed belt, at a fixed height distance from the driver 22A, which is likewise fastened to the tension strap. A single drive therefore brings about the buckling and locking, on the one hand, and the opening and closing, on the other hand.

Figures 7A, 7B, 7C:
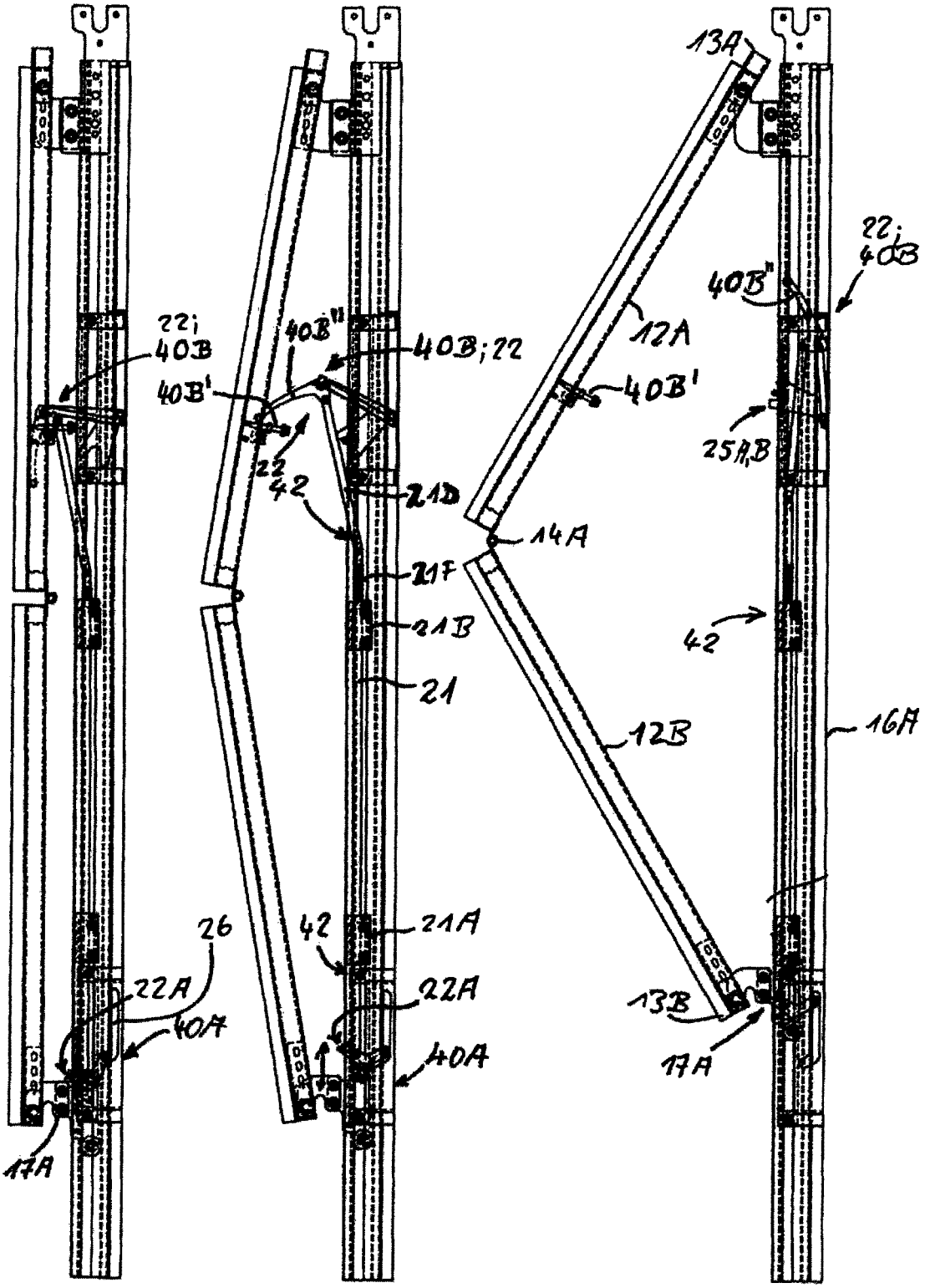
FIGS. 7A-D show a side view of a sixth embodiment of a folding arrangement with two folding shutter elements and a buckling aid and with a second lock, in a closed position (FIG. 7A), in a slightly buckled position (FIG. 7B) and in a further open position (FIG. 7C) and also in the form of a simplified detailed illustration (FIG. 7D)
Figure 7D:
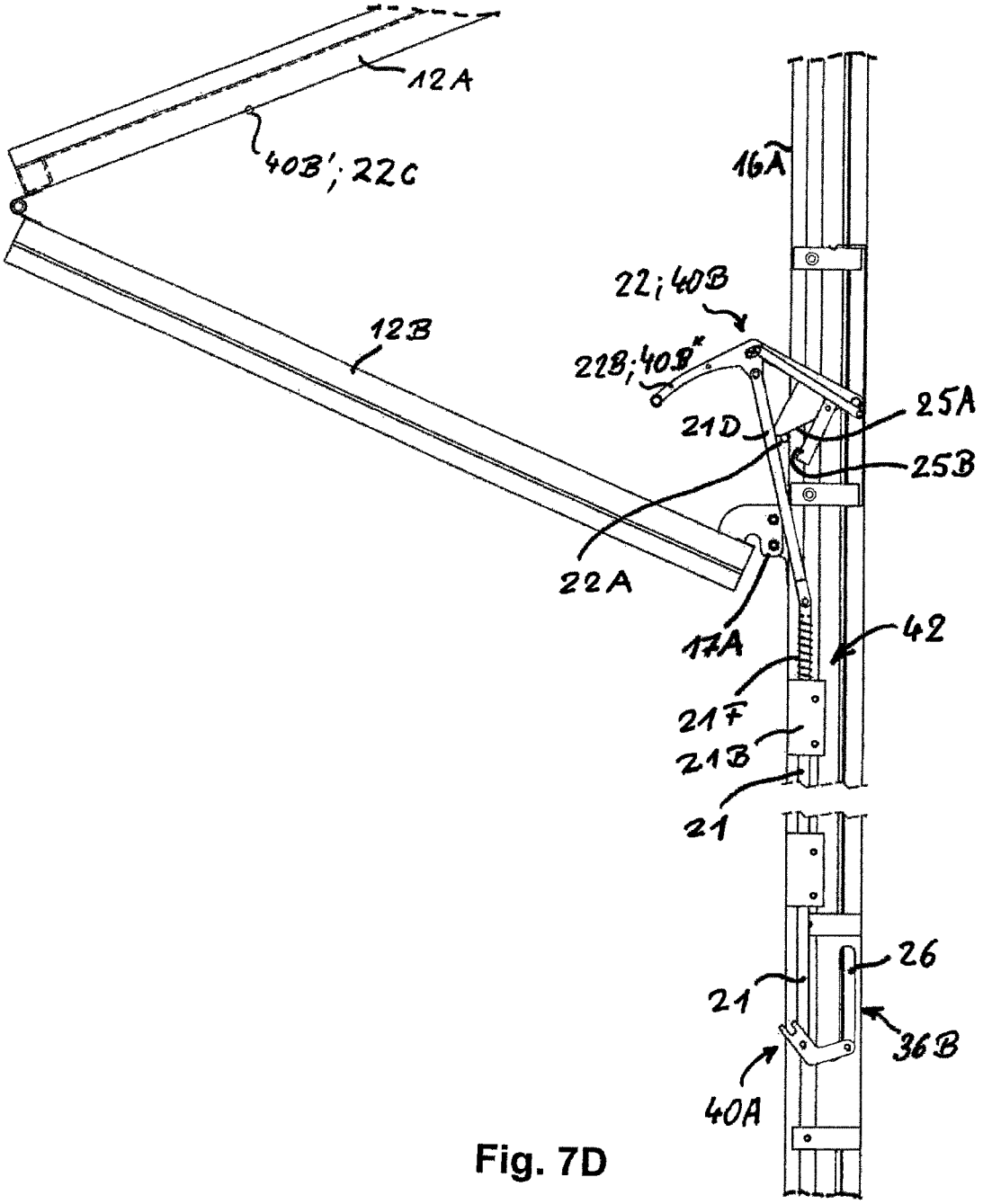

In the exemplary embodiment according to FIGS. 7A, 7B with only two folding shutter elements 12A and 12B, remote locking and unlocking and also buckling of one of the folding shutter elements—the upper folding shutter element 12A by way of example in the drawing—are likewise undertaken, as in principle already known from FIG. 2 and as also at least partially apparent from FIGS. 8 and 9. In all of these exemplary embodiments, an extension means 42 serves remotely to actuate a locking and/or unlocking means and/or buckling means 22 or 40B situated higher, or, if desired, lower. In this case, the locking and/or unlocking means and/or buckling means 40B carries out a multiple function, since it can also serve as an actively driven buckling means, in the same manner as the pulling-up and locking device 22 according to the exemplary embodiment in FIGS. 6A to 6C. Also in this exemplary embodiment, the driven moving carriage 17A is provided with a lower locking/unlocking for the extended closed position (FIG. 7A), which can also be designed, by way of example, approximately as per FIG. 2, 8 or 9. FIG. 7 illustrates locking and/or unlocking means 40A and 40B to the extent that they emerge in more detail from the detailed illustration according to FIG. 7D: the essential design of the locking and/or unlocking means 40B corresponds to the likewise remotely operated version according to FIG. 2. In addition, a double stop 25A/B (FIG. 7D) is provided, the double stop permitting the locking lever 22B or 40B" to be completely pivoted upward and back again by means of the driver 22A, as is apparent from FIG. 7C. For this purpose, the locking lever 40A" which is pivotably connected to the lower end of the sliding rod 21 of the extension means 42 is shiftable along a positionally fixed guide slot.

Figure 8A:
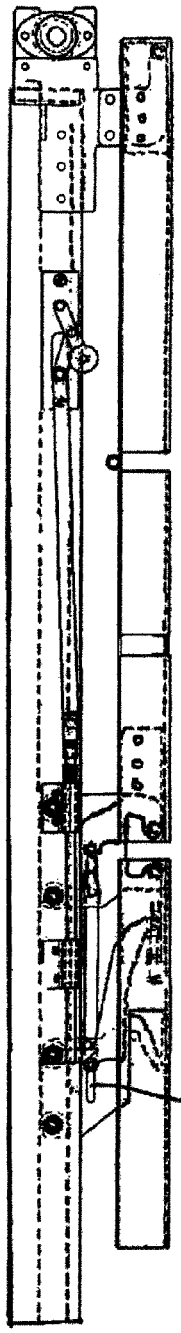
FIGS. 8A-E show a side view of a seventh embodiment of a folding arrangement, with three folding shutter elements and a buckling aid, in a closed position (FIG. 8A), in a slightly buckled position (FIG. 8B) and in a full opening position (FIG. 8C), and also in an alternative (FIGS. 8D and 8E)—as an excerpt.
Figure 8B:
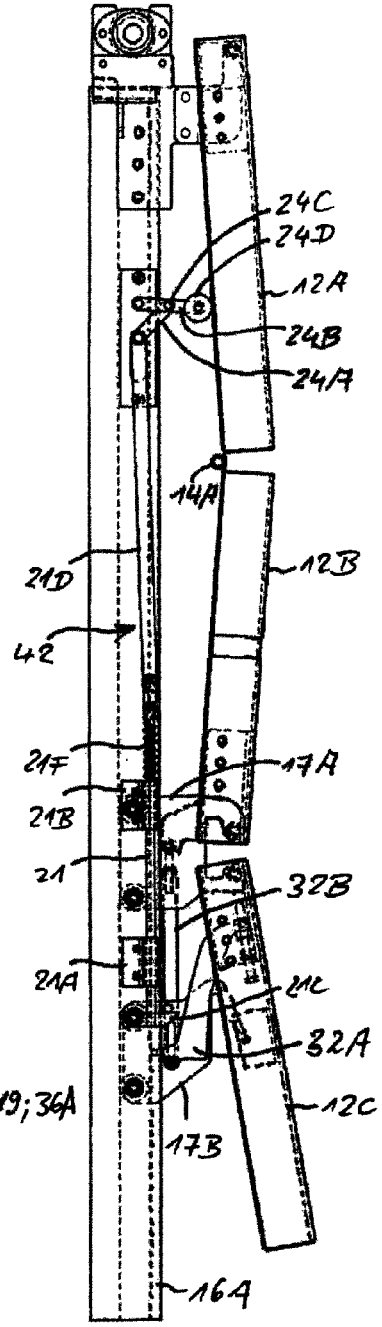
Figure 8C:
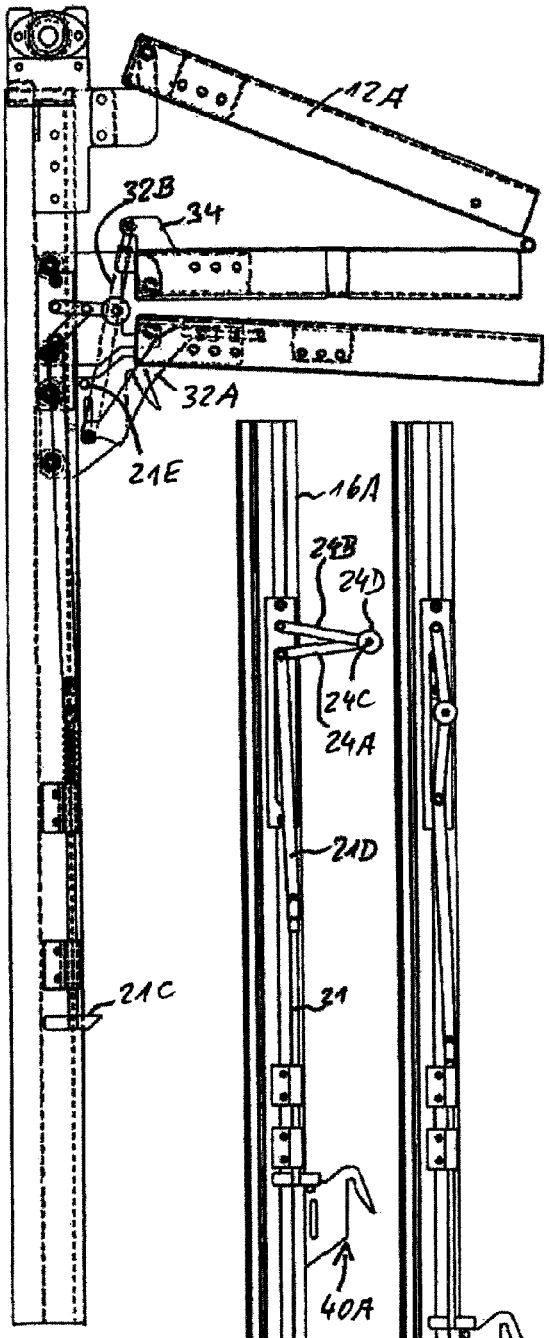
Figure 8D:
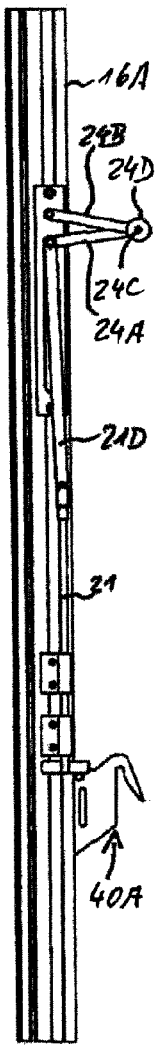
Figure 8E:
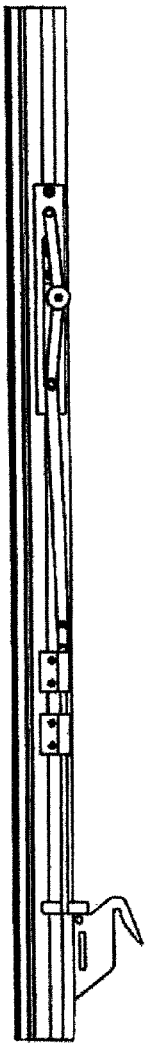
Figures 9A, 9B:
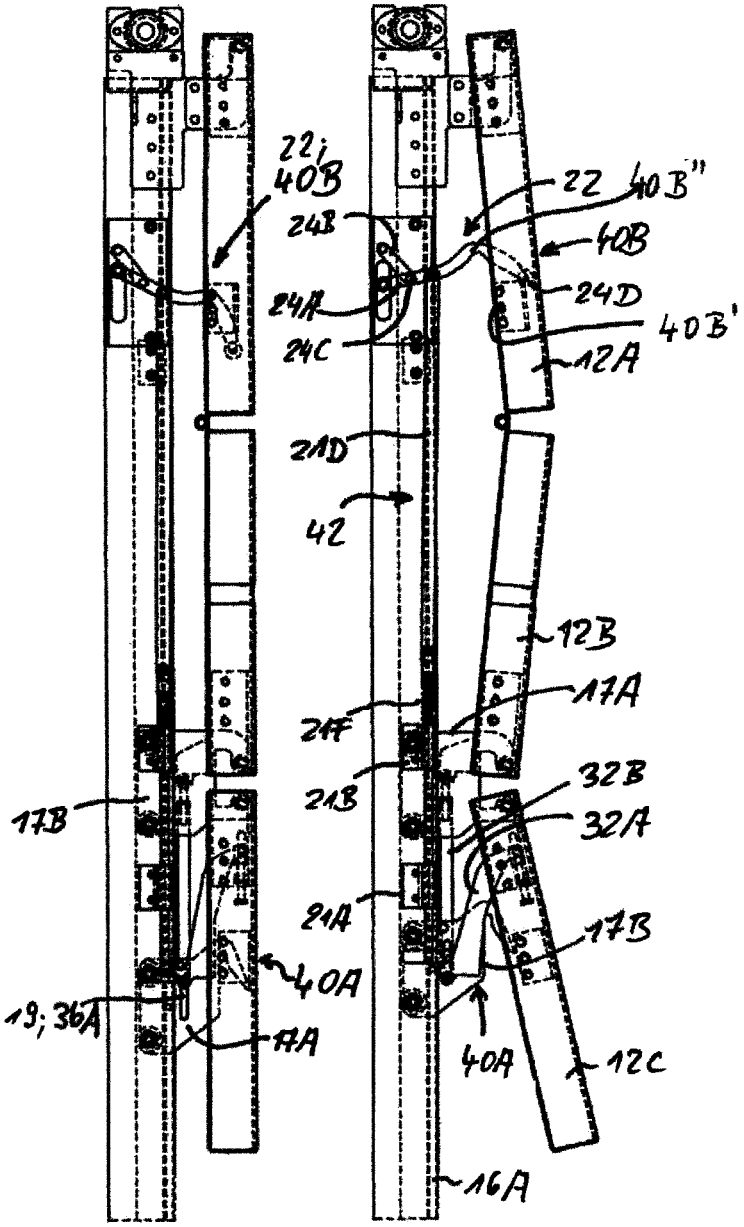
FIGS. 9A-B show a side view of an eighth embodiment of a folding arrangement, with three folding shutter elements and a buckling aid and with a second lock, in a closed position (FIG. 9A), in a slightly buckled position (FIG. 9B), and also
Figures 10A, 10B, 10C, 10D:
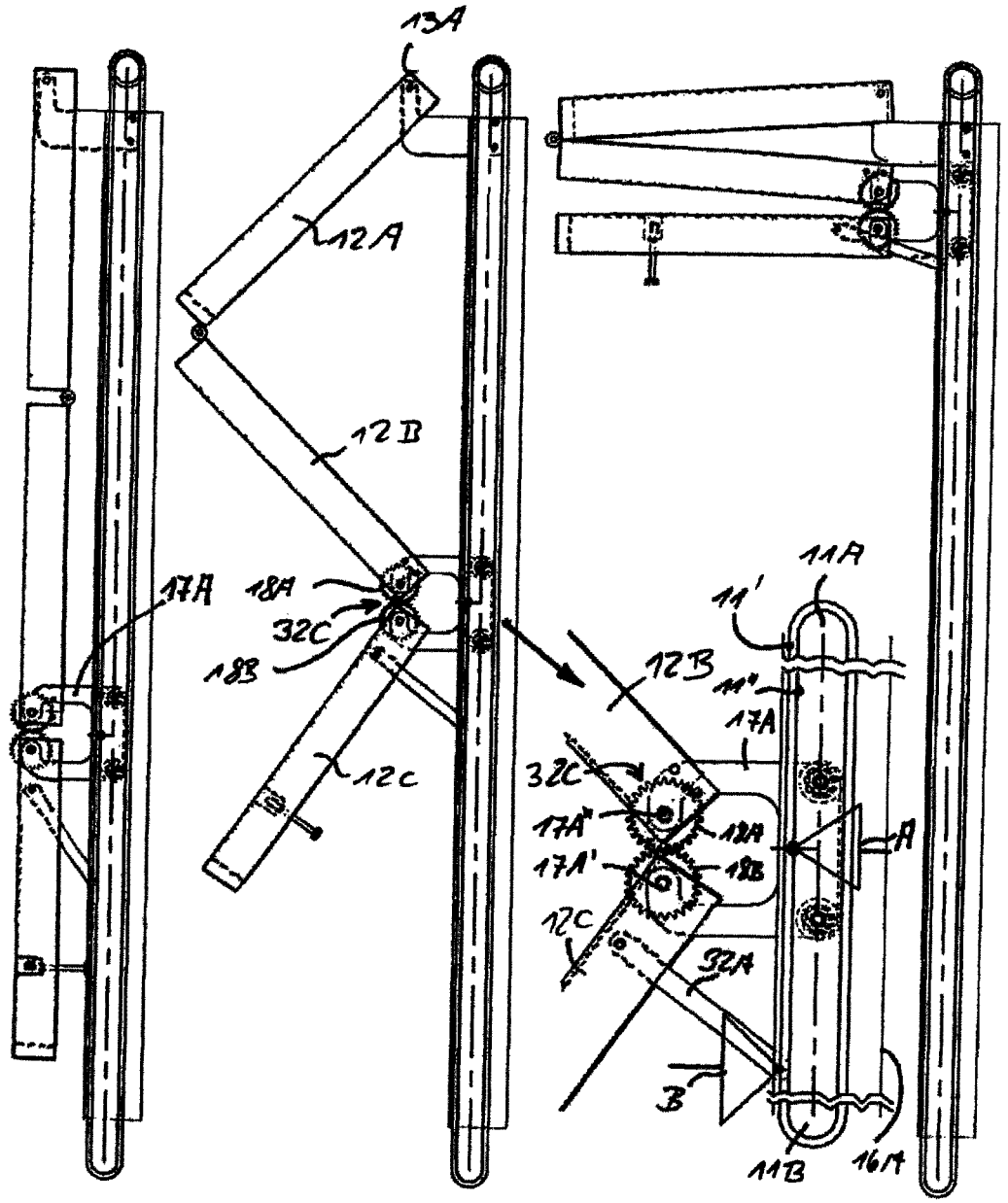
FIGS. 10A-D show a side view of a ninth embodiment of a folding arrangement, with three folding shutter elements, in a closed position (FIG. 10A), in an approximately half-buckled position (FIG. 10B) and in a full opening position (FIG. 10C), and also in detail with regard to FIG. 10B (FIG. 10D).

The exemplary embodiment according to FIGS. 8A to 8E shows a three-winged folding shutter arrangement which differs from the embodiment according to FIGS. 1A to 1C in that an additional buckling aid 24 is provided. In the two alternatives shown in FIG. 8, namely FIGS. 8A to 8C, on the one hand, and FIGS. 8D, 8E, on the other hand, the buckling aid 24 comprises a toggle lever arrangement, consisting of the levers 24A and 24B, which are connected pivotably to each other via a toggle lever joint 24C and, as buckling means, bear, for example, a roller 24D which is assigned to the toggle lever joint 24C and presses against one of the upper folding shutter elements (the folding shutter element 12A in the drawing) as a buckling assistance, as illustrated in FIG. 8B. In order to actuate the buckling aid 24, an extension means 42 is again provided, as already implemented in conjunction with the sliding rod arrangement 21 to 21E in FIG. 2 in the form of the outer side of the locking lever 40B". Owing to the toggle lever arrangement, comparatively strong buckling forces can be produced in a simple manner without an additional drive being required. The second coupling element 32B, which is illustrated in FIGS. 8A to 8C, can therefore generally be omitted. It is also possible to omit the first coupling element 32A, namely if a third coupling element 32C is used, such as intermeshing toothed segments, for example according to FIGS. 3A to 3D. It is likewise possible to provide or to combine a toggle lever arrangement according to FIGS. 8A to 8C with an upper locking and unlocking element. This in turn, enables relatively large locking forces with little use of driving force. Such a combination is found in the exemplary embodiment according to FIGS. 9A, 9B.

Finally, the exemplary embodiment according to FIGS. 10A to 10D shows an alternative, according to which a freely projecting folding shutter element can be pivoted without a second guide carriage, and the entire folding shutter arrangement can be opened and closed with the same drive. For this purpose, the guide carriage 17A is raisable and lowerable with a revolving drive element, such as a toothed belt 11, and is connected thereto at the fastening point A. A coupling element 32A, as known, for example, according to the exemplary embodiment from FIGS. 1A to 1D, is connected to the freely projecting folding shutter element 12C in the pivoting-out direction and, at its drive-side end, is connected to the drive element, such as a toothed belt 11, via a fastening point B. In order initially to buckle the folding shutter elements to a small extent from the extended closed position according to FIG. 10A, an elongated hole, for example, can be provided at the fastening point A of the guide carriage 17A, along which elongated hole the fastening point A can be displaced relative to the guide carriage 17B. In order to bring about pronounced pivoting-out of the lower folding shutter element 12C when the guide carriage 17A is raised, the driving speeds of the fastening points A and B may differ. For example, the driving cables 11', 11" can run over upper and lower deflecting pulleys 11A, 11B of differing size such that, at the same angular speed of the deflecting pulleys, the tension cable 11', which is guided around the larger deflecting pulleys in each case, moves more rapidly than the other one.

List of Designations

1 Building
10 Folding shutter arrangement
11 Tension strap, such as toothed belt
11A,B Deflecting pulleys
12 Folding shutter elements
12A First folding shutter element
12A' First axis
12B Second folding shutter element
12B' Second axis
12C Third folding shutter element
12D Fourth folding shutter element
12E Fifth folding shutter element
13A First element edge
13B Second element edge
13C Third element edge
14A,B Buckling joint
15A/B Third element edge
16A/B Guides
17A First guide carriage
17A',A" Pivot bearing
17B Second guide carriage
17B' Extension arm
17B" Locking cutout
17B"' Locking stop
17C,D Guide rollers
18A-D Pairs of gearwheels
19 Elongated hole
19A,B Pivot points
20 Buckling element
21 Sliding rod
21A,B Sliding rod guide
21C,E Stop
21D Sliding rod extension
21F Compression spring
22 Pulling-up, locking and unlocking device
22A Driver
22B Locking lever
22C Locking stop
24 Buckling aid
24A,B Lever
24C Toggle lever joint

24D Roller
25A,B Double stop
26 Guide slot
30 Drive element
32A First coupling element
32B Second coupling element
32C Third coupling element
34A,B Pivot arm
36A,B Idle travel means
38 Solar panel
39A,B Surface elements
39C,D Drives
40A,B Locking and/or unlocking means and/or buckling means
40A',B' Locking stop I
40A",40B" Locking lever
42 Extension means
A,B Fastening points

The invention claimed is:

1. A folding shutter arrangement that is movable between an open and closed position, said folding shutter arrangement including a first rigid folding shutter element, an intermediate rigid folding shutter element, and an end rigid folding shutter element, each of said rigid folding shutter elements having a first folding edge and a second folding edge, said first rigid folding shutter element pivotally fastened at said first folding edge by a first joint or hinge to a fixed structure such that said first rigid folding shutter element only pivots relative to the fixed structure, said second folding edge of said first rigid folding shutter element pivotally connected to said first folding edge of one of said intermediate rigid folding shutter element by second joint or hinge, said second folding edge of one of said intermediate rigid folding shutter element connected to a guide carriage arrangement by a third joint or hinge, said guide carriage arrangement movably connected to a first guide and movable along a longitudinal length of said first guide, said guide carriage arrangement positioned closest to said first joint or hinge when said folding shutter arrangement is in said open position, said first folding edge of said end rigid folding shutter element pivotally connected to said guide carriage arrangement by a fourth joint or hinge, said second folding edge of said intermediate rigid folding shutter element and said first folding edge of said end rigid folding shutter element are independently pivotally connected to said guide carriage arrangement, said first folding edge of said end rigid folding shutter element is pivotally connected to said guide carriage arrangement such that when said guide carriage arrangement moves toward the fixed structure said second folding edge of said end rigid folding shutter element is caused to pivot toward the fixed structure, said first folding edge of said end rigid folding shutter element is pivotally connected to said guide carriage arrangement such that when said guide carriage arrangement moves away from the fixed structure said second folding edge of said end rigid folding shutter element is caused to pivot away from the fixed structure.

2. The folding shutter arrangement as defined in claim 1, wherein said intermediate rigid folding shutter element and said end folding shutter element are spaced from said first guide.

3. The folding shutter arrangement as defined in claim 1, includes a secondary guide carriage arrangement, said secondary guide carriage arrangement is movably connected to said first guide and movable along a longitudinal length of said first guide, said secondary guide carriage arrangement is spaced from said guide carriage arrangement, said end rigid folding shutter element is independently connected to both said secondary guide carriage arrangement and said guide carriage arrangement, a spacing between said secondary guide carriage arrangement said guide carriage arrangement is smallest when said folding shutter arrangement is in said open position.

4. The folding shutter arrangement as defined in claim 2, includes a secondary guide carriage arrangement, said secondary guide carriage arrangement is movably connected to said first guide and movable along a longitudinal length of said first guide, said secondary guide carriage arrangement is spaced from said guide carriage arrangement, said end rigid folding shutter element is independently connected to both said secondary guide carriage arrangement and said guide carriage arrangement, a spacing between said secondary guide carriage arrangement said guide carriage arrangement is smallest when said folding shutter arrangement is in said open position.

5. The folding shutter arrangement as defined in claim 3, wherein said secondary guide carriage arrangement includes a shutter element movement arrangement, said shutter element movement arrangement configured to cause said end rigid folding shutter element to pivot upwardly from said first guide when said secondary guide carriage arrangement and said guide carriage arrangement moves toward said first joint or hinge, said shutter element movement arrangement configured to cause said end rigid folding shutter element to pivot downwardly toward said first guide when said secondary guide carriage arrangement and said guide carriage arrangement moves away from said first joint or hinge.

6. The folding shutter arrangement as defined in claim 4, wherein said secondary guide carriage arrangement includes a shutter element movement arrangement, said shutter element movement arrangement configured to cause said end rigid folding shutter element to pivot upwardly from said first guide when said secondary guide carriage arrangement and said guide carriage arrangement moves toward said first joint or hinge, said shutter element movement arrangement configured to cause said end rigid folding shutter element to pivot downwardly toward said first guide when said secondary guide carriage arrangement and said guide carriage arrangement moves away from said first joint or hinge.

7. The folding shutter arrangement as defined in claim 5, including a coupling member, a first end portion of said coupling member is connected to said secondary guide carriage arrangement and a second end portion of said coupling member is connected to said intermediate rigid folding shutter element, movement of said intermediate rigid folding shutter element as said folding shutter arrangement moves between said open and closed position causing said secondary guide carriage arrangement to move closer to and farther away from said guide carriage arrangement.

8. The folding shutter arrangement as defined in claim 6, including a coupling member, a first end portion of said coupling member is connected to said secondary guide carriage arrangement and a second end portion of said coupling member is connected to said intermediate rigid folding shutter element, movement of said intermediate rigid folding shutter element as said folding shutter arrangement moves between said open and closed position causing said secondary guide carriage arrangement to move closer to and farther away from said guide carriage arrangement.

9. The folding shutter arrangement as defined in claim 7, wherein said first end portion of said coupling member is movably connected in said slot and movable toward a first end of said slot when said guide carriage arrangement said first guide when said secondary guide carriage arrangement and said guide carriage arrangement moves away from said first joint or hinges, a second end of said slot positioned closer to said guide carriage arrangement than said first end of said slot.

10. The folding shutter arrangement as defined in claim 8, wherein said first end portion of said coupling member is movably connected in said slot and movable toward a first end of said slot when said guide carriage arrangement and said guide carriage arrangement moves away from said first joint or hinges, a second end of said slot positioned closer to said guide carriage arrangement than said first end of said slot.

11. The folding shutter arrangement as defined in claim 1, including a drive arrangement that engages said guide carriage arrangement and causes said guide arrangement to move along said longitudinal length of said first guide.

12. The folding shutter arrangement as defined in claim 10, including a drive arrangement that engages said guide carriage arrangement and causes said guide arrangement to move along said longitudinal length of said first guide.

13. The folding shutter arrangement as defined in claim 11, wherein said drive arrangement includes a drive element and an electric motor, said electric motor causing said drive element in said first guide along said longitudinal length of said first guide, said drive element connected to said guide carriage arrangement.

14. The folding shutter arrangement as defined in claim 12, wherein said drive arrangement includes a drive element and an electric motor, said electric motor causing said drive element in said first guide to move along said longitudinal length of said first guide, said drive element connected to said guide carriage arrangement.

15. The folding shutter arrangement as defined in claim 1, wherein said intermediate rigid folding shutter element includes a single rigid folding shutter element.

16. The folding shutter arrangement as defined in claim 1, wherein said intermediate rigid folding shutter element includes a plurality of rigid folding shutter elements.

17. The folding shutter arrangement as defined in claim 1, wherein said guide carriage arrangement includes a plurality of guide carriages.

* * * * *